United States Patent [19]

Miyahara

[11] Patent Number: 4,551,089

[45] Date of Patent: Nov. 5, 1985

[54] EVAPORATION BURNER

[75] Inventor: Kingo Miyahara, Tokyo, Japan

[73] Assignee: Dowa Company, Ltd., Tokyo, Japan

[21] Appl. No.: 635,582

[22] Filed: Jul. 30, 1984

[51] Int. Cl.[4] ..... F23D 11/44

[52] U.S. Cl. ..... 431/116; 431/158; 431/210; 431/328

[58] Field of Search ..... 431/116, 158, 210, 328, 431/329, 115

[56] References Cited

U.S. PATENT DOCUMENTS 3,238,991 3/1966 Goldmann et al. ..... 431/328

3,922,136 11/1975 Koch ..... 431/115

FOREIGN PATENT DOCUMENTS 21170 4/1983 Japan .

*Primary Examiner*—Carroll B. Dority, Jr.

*Attorney, Agent, or Firm*—Wegner & Bretschneider

[57] ABSTRACT

An evaporation burner comprises a burning unit having a hollow gas chamber therein and burning plates on its surface, a gas generating chamber through which a preheat burning flame may flow, an inlet window through which the preheat burning flame within the gas generating chamber may flow into the burning unit, and recirculation windows through which apart of the preheat burning flame entering into the burning unit may be recirculated back to the gas generating chamber. The gas generating chamber is located adjacent to the burning unit and substantially along the centerline of the burning unit. The burning unit and the gas generating chamber are communicated to each other. The recirculation windows are adjusted to vary their closing/opening degree, as desired, by an opening/closing damper.

2 Claims, 9 Drawing Figures

EVAPORATION BURNER

BACKGROUND OF THE INVENTION

The present invention relates to an evaporation burner capable of readily attaining a complete combustion of a preheat burning flame, by preheating rapidly to the vaporized gas generating ambient temperature a gas generating unit and a burning unit arranged adjacent to each other, thereafter vaperizing or gasifying the fuel supplied together with the combustion air, and burning the gas mixture through a number of injection flame ports.

The present applicant has proposed an evaporation burner in the Japanese Patent Publication No. 21170/83, in which a gas generating unit through which a preheat burning flame flows and a burning unit having therein a hollow gas chamber and a number of flame injection ports in its surface are arranged adjacent to each other. A distal or free end of the gas generating unit is connected to the burning unit through communication windows, so that the gas generating unit and the burning unit are rapidly preheated from the inside by the flow action of the preheat burning flame generated in the gas generating unit, and at the same time, a part of the preheat burning flame injecting through the injection ports is directed to the gas generating unit to heat the gas generating unit from the outside. Thereafter the fuel supplied into the gas generating chamber is vaporized or gasified togehter with the combustion air to generate a gas mixture. Then, the gas mixture is directed upwardly from the injection ports of the burning unit while heating the gas generating unit around its periphery, thereby burning the gas mixture. Thus, the evaporation combustion is continued.

In such a conventional evaporation burner, since the burning unit connected to the distal and side of the gas generating unit is closed except for the injection ports, the preheat burning flame introduced from the gas generating unit to the burning unit is gradually stagnant in the burning unit. Therefore, there will be a phenomenon where the burning flame flows reversely to the gas generating unit. As a result, an incomplete combustion is caused due to the fact that the area of the combustion chamber for the preheat burning flame is smaller. The material generated resulting from the incomplete combustion will plug or clog the injection ports, thereby resulting in degradation of the preheat effect of the gas generating unit. In addition, the material is also adhered to the inner surfaces of the gas generating unit and the burning unit, resulting in degradation of the vaporized gas generating performance. It is therefore difficult to continue the constant amount vaporized combustion in a stable manner.

SUMMARY OF THE INVENTION

Accordingly, an object of the present invention is to provide an evaporation burner wherein a gas generating chamber and a burning unit are arranged adjacent to each other, and the burning unit is connected at both sides to a distal end side and a proximal end side of the gas generating unit through recirculation windows, whereby without stagnation of the preheat burning flame in the burning unit, the preheat burning flame is freely recirculated smoothly between the gas generating unit and the burning unit, increasing a volume of the combustion chamber, attaining a complete combustion of the preheat burning flame, promoting the preheat of the gas generating unit and the burning unit and attaining an automatic transition from the wet combustion state to the vaporized conbustion state for a short period of time, thereby enabling to continue a stable vaporized combustion and freely adjusting the degree of clasing or opening of the recirculation windows in response to the combustion state to adjust the preheat combustion flame and the vaporized combustion flame.

In view of the above, to attain the object, there is provided an evaporation burner comprising a burning unit having a hollow gas chamber therein and burning plates on its surface, a gas generating chamber through which a preheat burning flame may flow, the gas generating chamber being located adjacent to the burning unit and substantially along the centerline of the burning unit, an inlet window through which the preheat burning flame within the gas generating chamber may flow into the burning unit, and recirculation windows through which a part of the preheat burning flame entering into the burning unit may be recirculated back to the gas generating chamber, the burning unit and the gas generating chamber being communicated to each other.

Also, according to another aspect of the present invention, there is provided an evaporation burner comprising a burning unit having a hollow gas chamber therein and burning plates on its surface, a gas generating chamber through which a preheat burning flame may flow, the gas generating chamber being located adjacent to the burning unit and substantially along the centerline of the burning unit, an inlet window through which the preheat burning flame within the gas generating chamber may flow into the burning unit, and recirculation windows through which a part of the preheat burning flame entering into the burning unit may be recirculated to the gas generating chamber, the burning unit and the gas generating chamber being communicated to each other, said recirculation windows being adjusted to vary their closing/opening degree as desired by an opening/closing damper.

According to the evaporation burner, upon starting the vaporized burning, even through the preheat burning flame generated in the gas generating chamber is made to flow through the inlet window into the adjacent burning unit in order to preheat the gas generating chamber and the burning unit to the vaporized gas generating ambient temperature, the preheat burning flame may be burnt while being recirculated from the burning unit through the recirculation windows back to the gas generating chamber. Therefore, the burning chamber area for the preheat burning flame is not remarkably increased, so that the preheat burning flame is not stagnant in the burning unit. Therefore, there is not fear that the preheat burning flame would be made to flow reversely to the gas generating chamber to cause an incomplete combustion, the material resulting from the incomplete combustion to plug or clog the burning plate and to adhere to the inner surfaces of the gas generating unit and the burning unit. Thus, the complete combustion of the preheat burning flame may readily be attained. The gas generating chamber and the burning unit are preheated from the insides for a short period of time. At the same time, the outer peripheries thereof are also heated by a part of the preheat burning flame injected from the burning plates. Thereafter, the fuel fed to the gas generating chamber is rapidly vaporized or gasified. The generated vaporized gas is agitated and mixed with the supplied combustion air to thereby complete gas mixture while automatically attaining the transition to the vaporized combustion. At the same time, prior to the transition to the vaporized combustion or even after the transition, the recirculation windows are adjusted as desired to vary their closing/opening degree by operating the opening/closing damper, so that the recirculation amounts of the preheat burning flame and the gas mixture are freely adjusted. Thus, a suitable and stable preheating action or vaporized combustion is always maintained.

DETAILED DESCRIPTION OF THE PREFERRED EMBODIMENTS

The present invention will now be described with reference to the accompanying drawings.

Figure 1:
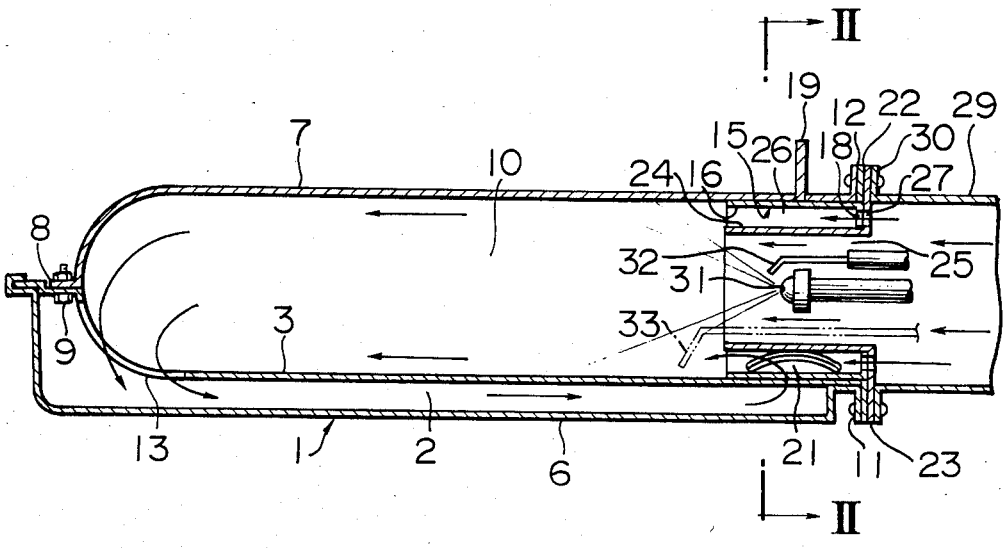
FIG. 1 is a partially fragmentary logitudinal-sectional view showing an evaporation burner in accordance with the first embodiment of the invention.
Figure 2:
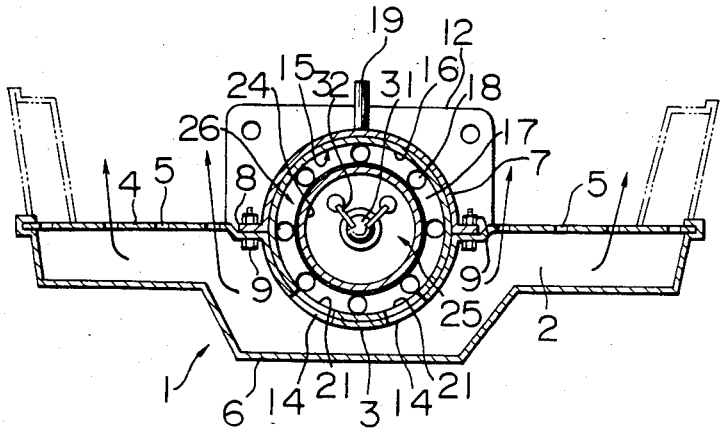
FIG. 2 is a cross-sectional view taken along the line II—II of FIG. 1.
Figure 3:
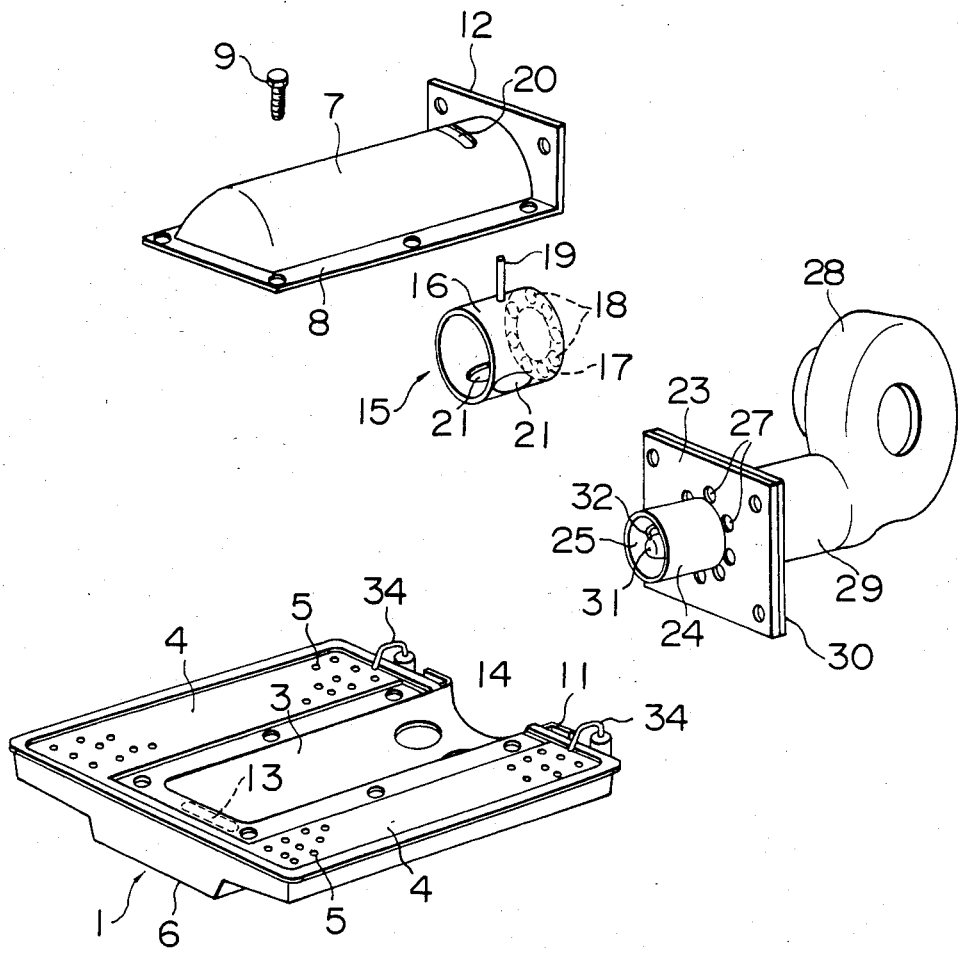
FIG. 3 is an exploded perspective view of the burner shown in FIGS. 1 and 2.

In FIGS. 1 to 3, there is shown an evaporation burner in accordance with a first embodiment of the invention, in which a recessed surface 3 is integrally formed essentially along a longitudinal centerline of a flat rectangular burning unit 1. The recessed surface 3 is covered by an arcuate cover plate 7 so that the burning unit 1 is located adjacent to a gas generating chamber 10. More specifically, the burning unit 1 is formed generally in a flat rectangular shape and has an inner hollow space which serves as a gas chamber 2. Further, substnatially in the centerline of a burning plate 4 provided on the upper side of the burning unit 1, there is formed the arcuate recessed surface 3 extending in the longitudinal direction. A number of injection ports 5 through which the gas chamber 2 communicates are formed in the surface of the burning plate 4 except for the recessed surface 3. A part, which is confronted with the recessed surface 3, of a bottom wall 6 of the burning unit 1 is made to project outwardly.

The arcuate cover plate 7 is arranged so as to cover the upper portion of the recessed surface 3 of the burning unit 1. A peripheral edge flange 8 of the cover plate 7 is mounted on a peripheral portion of the recessed surface 3 through fastening means 9 so that the longitudinal gas generating chamber 10 having a circular cross-section is formed. Proximal ends of the arcuate recessed surface 3 and the arcuate cover plate 7 extends outwardly beyond the burning unit 1 by substantially the same length. This makes it possible to provide mounting flanges 11 and 12 at the proximal ends, respectively.

The burning unit 1 and the gas generating chamber 10 which are arranged adjacent to each other as described above are connected so as to communicate with each other through a single inlet window 13 formed on the distal end side of the recessed surface 3 and two recirculation windows 14, 14 formed on the proximal end side in symmetrical relation with respect to the centerline. A preheat burning flame generated within the gas generating chamber 10 may freely enter from the gas generating chamber 10 through the inlet window 13 to the interior of the burning unit 1. Subsequently, a part of the preheat burning flame which has entered into the gas chamber 2 may be recirculated through the two recirculation windows 14, 14 to the proximal end side of the gas generating chamber 10. Thus, the preheat burning flame is freely recirculated between the burning unit 1 and the gas generating chamber 10, so that a surface area of the combustion chamber is remarkably increased and the preheating burning flame is completely burnt. An opening/closing damper 15 serves to fully open or close the two recirculation windows 14, 14 at the same time and to adjust the opening degree thereof as desired. The opening/closing damper 15 is disposed in the gas generating chamber 10 on the proximal end side.

The opening/closing damper 15 is composed of an elongate hollow sleeve 16 provided at its proximal end with a centrally opened bent wall 17. The bent wall 17 is provided with a desired number of through holes 18 equiangularly at a constant interval.

A proximal end of a control rod 19 is affixed to the hollow sleeve 16 and the distal end thereof is assembled to project outwardly through an oblong slot 20 formed in the arcuate cover plate 7. Two communication openings 21, 21 which are identical with the recirculation windows 14, 14 are formed at the diametrically opposite positions, in the circumferential wall of the hollow sleeve 16, to the position where the control rod 19 is mounted.

Inside of the opening/closing damper 15, there is disposed a blower sleeve 24 provided integrally at a proximal end with a flange 23 which is to be mounted on the mounting flanges 11 and 12 through a packing 22. Thus, a main blow passage 25 is defined in the blower sleeve 24 and a sub-passage 26 is defined between the opening/closing damper 15 and the blower sleeve 24. The same number and configuration of through holes 27 as those of the through holes 18 are formed in the flange 23 confronted with the through holes 18. When the recirculation windows 14, 14 and the communication openings 21, 21 are fully opened by operating the control rod 19, the through holes 18 and the through holes 27 are made identical with each other. In the same manner, when the recirculation windows 14, 14 are shut off by the circumferential wall of the hollow sleeve 16, the through holes 27 are fully closed by the surface of the bent wall 17. Therefore, when the recirculation windows 14, 14 are opened at a desired opening degree, the through holes 27 are also opened at a corresponding opening degree so that air for combustion may flow through the sub-passage 26.

By a blower 28, air for combustion is made to flow to the gas generating chamber 10 through the main blow passage 25 and the sub-passage 26. A flange 30 provided at a distal end of a blower sleeve 29 of the blower 28 is mounted on the flange 23 in a predetermined manner.

An atomizing nozzle 31 is mounted substantially at the center of the main blow passage 25. An ignition spark plug therefor is indicated by reference numeral 32. In FIG. 1, an oil feed tube 33 is shown by the two-dot and chain line. When the fuel is vaporized or gasified by the preheating action and is in the gasified combustion state, the oil feed tube 33 serves to feed the fuel to the proximal end side of the recessed surface 3 instead of the atomizing nozzle 31 and to vaporize or gasify the fuel by the preheating action. Also, it is possible to raise the left and right edge portions of the burning unit 1 as indicated by the two-dotted and chain line in FIG. 2. This modification makes it possible to increase the surface area of the gas chamber 2 and the burning plate 4, resulting in an increase of the burning capacity and an enhancement of the preheating effect of the gas generating chamber 10.

Spark plugs 34 for gasified combustion are arranged to face the burning plates 4, 4 at their ends.

Figure 4:
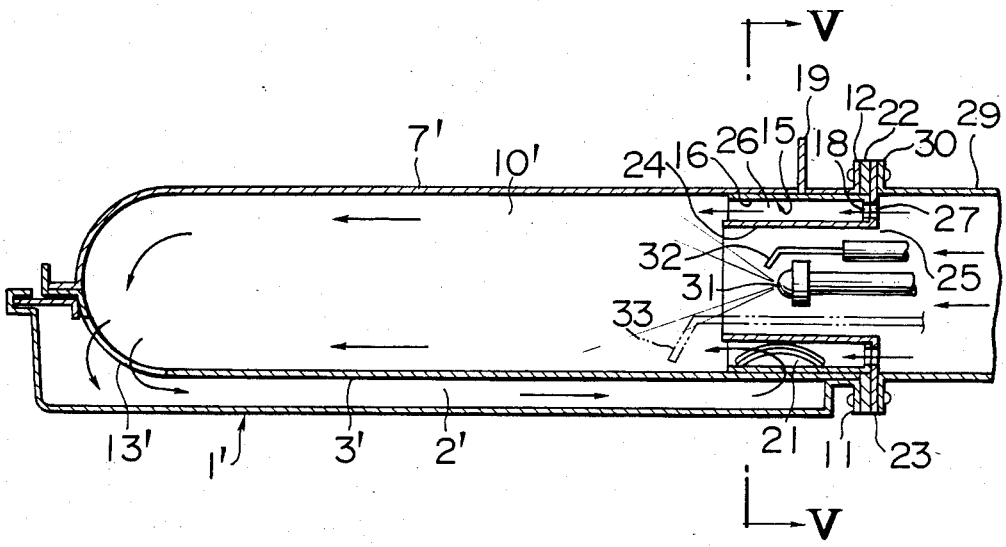
FIG. 4 is a partially fragmentary longitudinal-sectional view showing an evaporation burner in accordance with the second embodiment of the invention.
Figure 5:
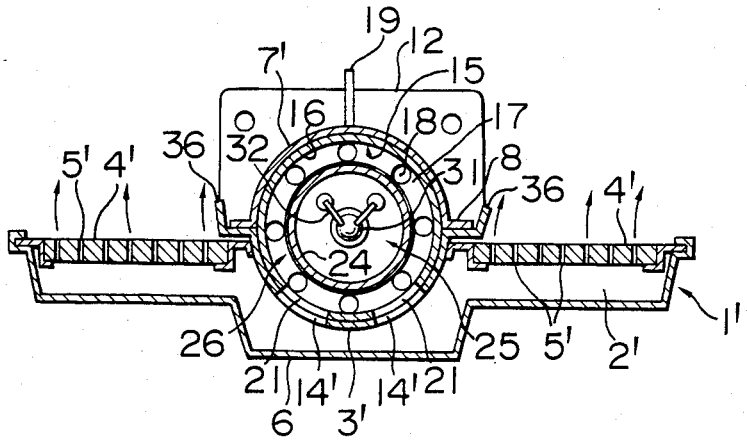
FIG. 5 is a cross-sectional view taken along the line V—V of FIG. 4.
Figure 6:
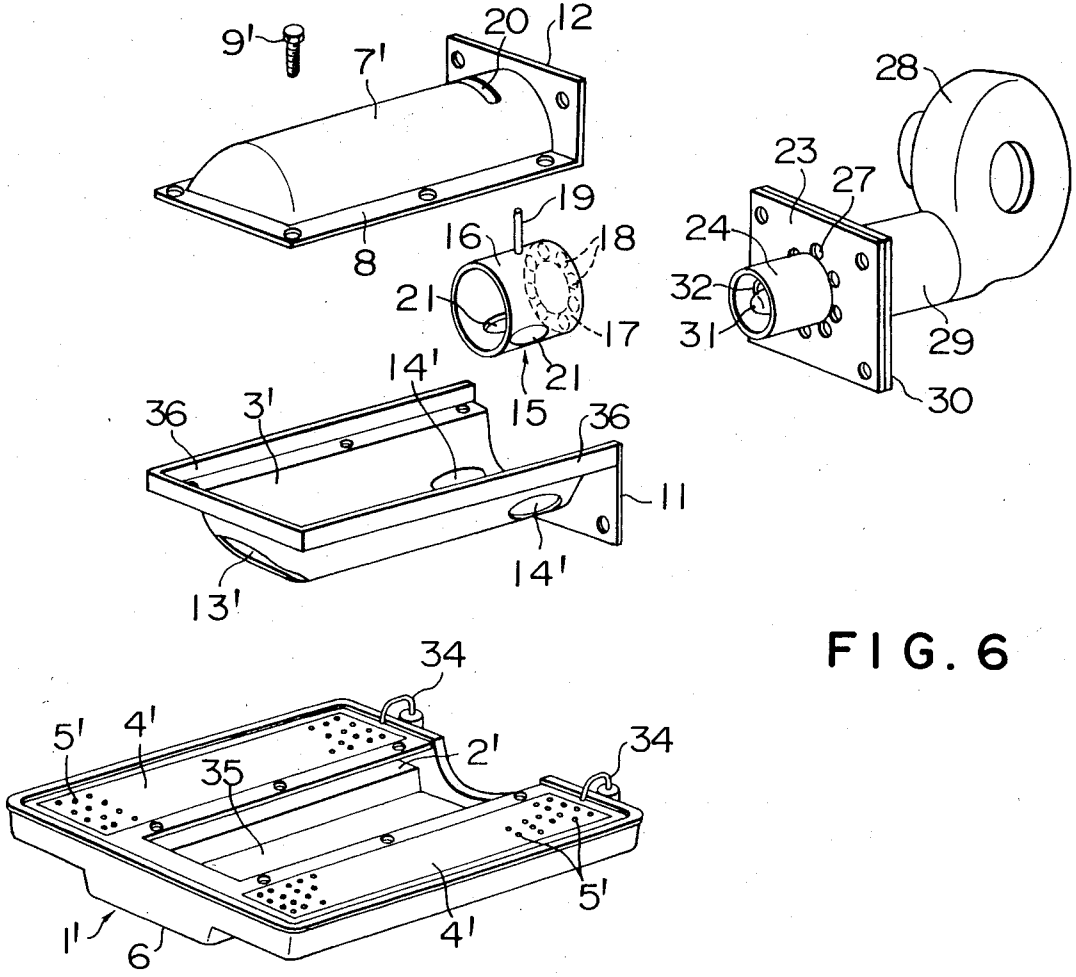
FIG. 6 is an exploded perspective view of the burner shown in FIGS. 4 and 5.

In a second embodiment shown in FIGS. 4 through 6, a recessed surface 3' formed centrally essentially in the longitudinal direction of a burning unit 1' is made discrete from the burning unit 1'. In such an evaporation burner, to enhance a heat transfer efficiency of the entire recessed surface 3', the fuel supplied in the gas generating chamber 10' is rapidly vaporized or gasified and a stable gasified combustion may be kept for a long period of time. In the second embodiment, the substantially central surface of the flat rectangular burning unit 1' having therein a hollow gas chamber 2' is opened along the longitudinal direction as designated by reference numeral 35. The surface except for the opened portion is covered by burning plates 4', 4' each having a number of gas injection ports 5'. An upright heat transfer wall 36 is integrally provided along the three peripheral edges, i.e., right and left sides and a distal end side of the opened portion 35. In addition, a lower half arcuate portion of the recessed surface 3' is disposed in the burning unit 1' to some extent. An inlet window 13' and two recirculation windows 14', 14' are formed on the distal and proximal end sides of the recessed surface 3', respectively.

An arcuate cover plate 7' is mounted inside of the heat transfer wall 36 provided along the three edges of the recessed surface 3'. The burning plates 4', 4', the recessed surface 3' and the arcuate cover plate 7' are coupled together by fastening members 9' while the burning unit 1' and the gas generating chamber 10' are arranged adjacent to each other and are communicable to each other through the inlet window 13' and the recirculation windows 14', 14'.

In this embodiment, the burning plates 4', 4' are made of ceramics in order to radiate infrared rays. However, the burning plates 4', 4' may be made of metal mesh or porous metal plates. The construction other than the thus far described construction is the same as that of the first embodiment.

Figure 7:
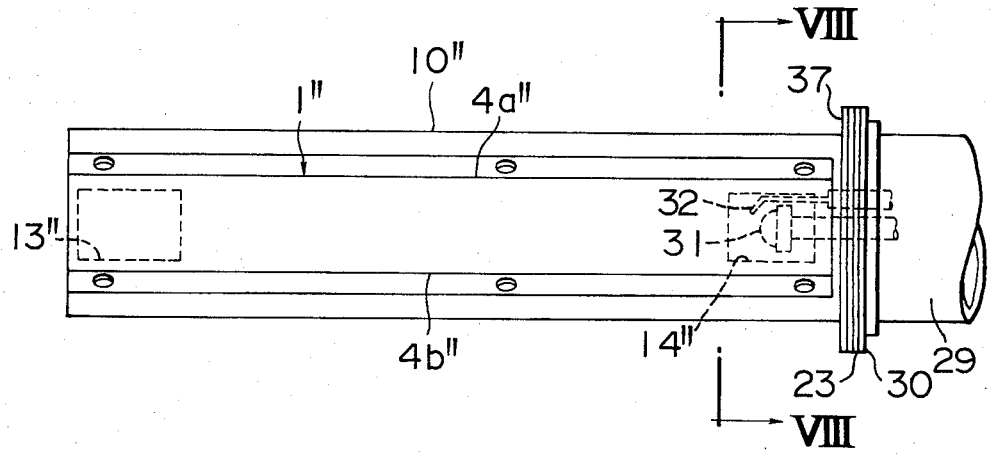
FIG. 7 is a partially fragmentary longitudinal-sectional view showing an evaporation burner in accordance with the third embodiment of the invention.
Figure 8:
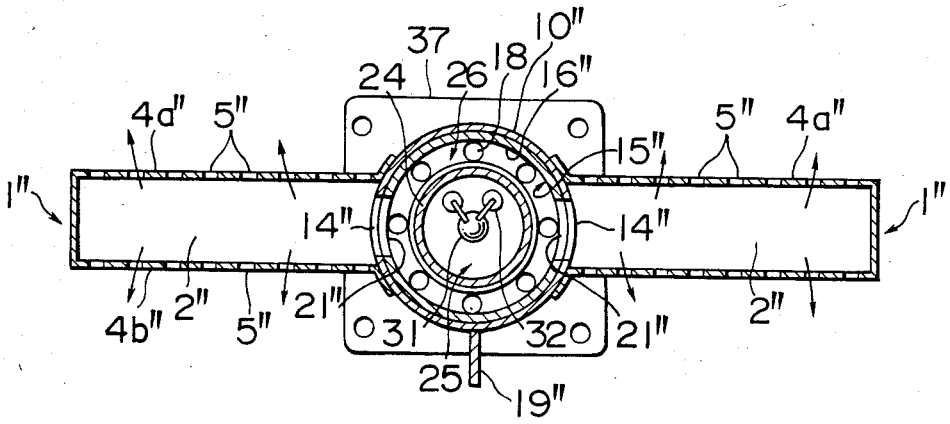
FIG. 8 is a cross-sectional view taken along the line VIII—VIII of FIG. 7.
Figure 9:
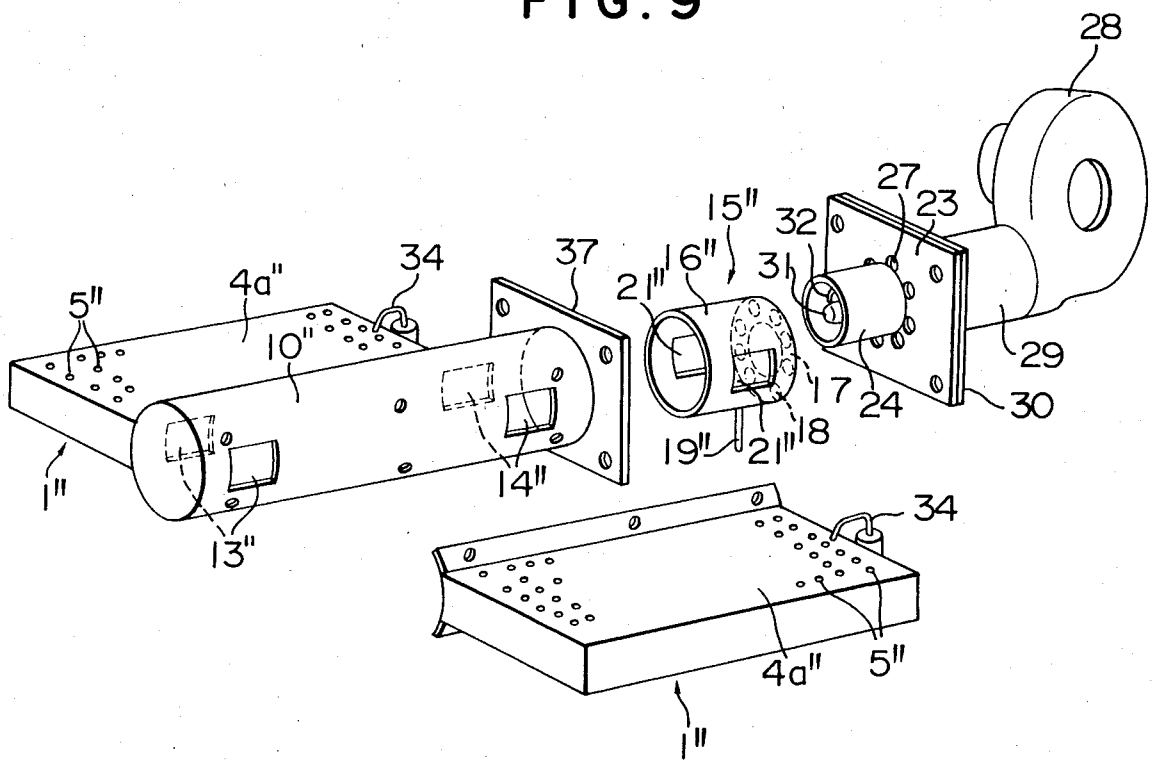
FIG. 9 is an exploded perspective view of the burner shown in FIGS. 7 and 8.

In a third embodiment shown in FIGS. 7 through 9, a preheating burning flame and gas mixture generated in the gas generating chamber 10'' are injected upwardly and downwardly from the burning unit 1'' to thereby further increase the burning capacity. In such an evaporation burner, the gas generating chamber 10'' is in the form of a longitudinal cylinder having a closed distal end and an open proximal ends. A square mounting flange 37 for being mounted on a flange 23 is integrally provided at the proximal end side of the gas generating chamber 10''. A pair of burning plates 4a'' and 4b'' each having a number of gas injection ports 5'' in its upper and lower surfaces are provided at symmetrical positions with respect to the centerline of the elongate gas generating chamber 10''. Right and left elongate rectangular burning units 1'', 1'' each opened at one side and having therein a hollow gas chamber 2'' are mounted so as to be confronted with each other. Inlet windows 13'', 13'' and recirculation windows 14'', 14'' which are communicated to the interior of the burning units 1'', 1'' are formed on the right and left sides of the distal and proximal end sides of the gas generating chamber 10'' so that the preheat burning flame is smoothly recirculated between the gas generating chamber 10'' and the burning units 1'', 1''.

Therefore, in the evaporation burner in accordance with the third embodiment, the same construction as in the first embodiment is adopted except for the construction where two communication ports 21'', 21'' are formed at the right and left symmetrical positions with respect to the centerline of the hollow sleeve 16'' of the opening/closing damper for opening/closing the recirculation windows 14'', 14'' and the control rod 19'' is mounted on the hollow sleeve 16'' with the rod being directed downwardly.

The operation of the foregoing embodiments will now be described.

In the embodiment shown in FIGS. 1 to 3, when the hollow sleeve 16 of the opening/closing damper 15 is rotated in one direction by the operation of the control rod 19 so that the recirculation windows 14, 14 and the communication ports 21, 21 are in alignment with each other to thereby open these openings in a fully opened state, the through holes 27 and the through holes 18 are also in alignment with each other in a fully opened state. Under such a condition, when the blower 28 operates and the combustion air is rendered to flow through the main blow passage 25, the through holes 27 and the through holes 18 to the subpassage 26 and at the same time, the fuel is injected into the gas generation chamber 10 from the injection nozzle 31 and then, is ignited by the spark plug 32, the preheat combustion flame is rapidly generated. Then, after the preheat burning flame flows through the gas generating chamber 10 toward the distal end thereof, the flame enters into the burning unit 1 from the inlet window 13 while preheating the recessed surface 3 and the interior of the gas generating chamber, and at the same time, the flame causes a part of the preheating burning flame to be injected from the gas injection ports 5. The other of the flame is introduced through the recirculation windows 14, 14 and the communication ports 21, 21 into the sub-passage 26, and then, is again recirculated into the gas generating chamber 10 together with the combustion air.

Therefore, since the part of the preheating burning flame is injected from the gas injection port 5 and the other is freely recirculated, the area of the combustion chamber is remarkably increased and in addition, the rate of flow is also increased to thereby completely burn the fuel. The gas generating chamber is heated by the part of the preheat burning flame from the outside and the interior of the gas generating chamber 10 is rapidly heated to a gasifying ambient temperature. Thus, when the interiors of the burning unit 1 and the gas generating chamber 10 are raised at a predetermined temperature, the fuel dispersion action of the injection nozzle 31 is temporarily interrupted, thereby stopping the continuation of the preheat burning flame and subsequently injecting and dispersing the fuel, supplied from the injection nozzle 31, into the preheated gas generating chamber 10 together with the combustion air.

Thus, the fuel is rapidly vaporized or gasified by the preheating action in the flow passage. The generated evaporated gas is agitated and mixed with the combustion air in the flow passage, to become a complete mixture. The mixture is made to flow from the inlet window 13 to the burning unit 1. The part of the mixture is injected upwardly from the number of gas injection ports 5, and, at the same time, the other is made to recirculated the recirculation windows 14, 14, the communication ports 21, 21 and the sub-passage 26 into the gas generating chamber 10.

When the mixture gas is injected upwardly through a number of the gas injection ports 5 in this manner, the recirculation windows 14, 14 are interrupted by the circumferential wall of the hollow sleeve 16 of the opening/closing damper 15 by operating the control rod 19, thereby bringing the windows in the fully closed state. As a result, the mixture gas which has entered from the gas generating chamber 10 into the burning unit 1 is retained in the burning unit 1 without the recirculation, and is injected from the gas injection ports 5 under a constant pressure thereby keeping the gasified combustion stable and heating the overall gas generating chamber 10 with the part of the gasified combustion flame from the outside. Thereafter the vaporizing gasifying action of the fuel injected into the gas generating chamber 10 is promoted. Incidentally, when the recirculation windows 14, 14 are under the fully closed state, the through holes 27 are also under the fully closed condition and the combustion air will flow through the main blow passage 25.

Accordingly, upon the generation of the preheat combustion flame fills and stagnates in the burning unit 1 without any reverse flow from the burning unit 1 to the gas generating chamber 10. Namely, the complete combustion may readily attained, and a state in which the gas injection ports 5 would be plugged or clogged by material generated due to the incomplete combustion is prevented or an unstable condition of the evaporated gas generation due to the adhesion of the material to the gas generating chamber 10 and the inner surface of the burning unit 1 may be prevented.

In addition, since the opening degree of the recirculation windows 14, 14 is freely adjusted by the opening/closing damper 15, the recirculation amounts of the preheat combustion flame and the gas mixture may be adjusted as desired and the injection amount of the injected flame from the gas injection ports 5 may be adjusted.

Also, since the burning unit 1 is always heated by the preheat burning flame, the gas mixture generated upon the transient vaporized combustion is prevented from being in the liquefied state.

In the second embodiment shown in FIGS. 4 through 6, although the recessed surface 3' is formed independently of the burning unit 1', the heat transfer wall 36 is strongly heated by the part of the burning flame injected from a number of gas injection ports 5'. The overall recessed surface 3' may be preheated at the vaporized gas generating ambient temperature by the heat transfer action. Therefore, even upon the transient state from the preheat combustion to the vaporized combustion, the dispersed fuel is positively gasified or vaporized so that the gas mixture may be stably obtained and the desired vaporized combustion may be continued.

Furthermore, in the evaporation burner in accordance with the third embodiment shown in FIGS. 7 to 9, the part of the preheat burning flame which has entered into the right and left burning units 1'', 1'' from the gas generating chamber 10'' is simultaneously injected upwardly and downwardly through the gas injection ports 5'' formed in the upper and lower surfaces of the burning plates **4*a*'' and 4*b*''. Even if the gas generating chamber 10'' is made cylindrical, not only the preheating effect is enhanced but also upon the transient state to the vaporized combustion, the great amount of the gas mixture is injected at a high speed from the upper and lower surfaces of the burning units 1'', 1''**, thereby driving an optimum performance from the heating instrument.

What is claimed is:

1. An evaporation burner comprising a burning unit having a hollow gas chamber therein and burning plates on its surface, a gas generating chamber through which a preheat burning flame may flow, said gas generating chamber being located adjacent to said burning unit and substantially along the centerline of said burning unit, an inlet window through which the preheat burning flame within said gas generating chamber may flow into said burning unit, and recirculation windows through which a part of the preheat burning flame entering into said burning unit may be recirculated back to said gas generating chamber, wherein said burning unit and said gas generating chamber are communicated to each other.

2. An evaporation burner comprising a burning unit having a hollow gas chamber therein and burning plates on its surface, a gas generating chamber through which a preheat burning flame may flow, said gas generating chamber being located adjacent to said burning unit and substantially along the centerline of said burning unit, an inlet window through which the preheat burning flame within said gas generating chamber may flow into said burning unit, and recirculation windows through which a part of the preheat burning flame entering into said burning unit may be recirculated back to said gas generating chamber, wherein said burning unit and said gas generating chamber are communicated to each other and said recirculation windows are adjusted to vary their closing/opening degree as desired by an opening/closing damper.

* * * * *